US009511983B2

(12) United States Patent
Eidenberger et al.

(10) Patent No.: US 9,511,983 B2
(45) Date of Patent: Dec. 6, 2016

(54) METHOD FOR CALIBRATING A MOVABLE CRANE PART OF A CRANE

(71) Applicant: PRIMETALS TECHNOLOGIES GERMANY GMBH, Erlangen (DE)

(72) Inventors: Robert Eidenberger, München (DE); Dirk Rehbein, Hattingen (DE); Thomas Wösch, München (DE)

(73) Assignee: PRIMETALS TECHNOLOGIES GERMANY GMBH (DE)

( * ) Notice: Subject to any disclaimer, the term of this patent is extended or adjusted under 35 U.S.C. 154(b) by 0 days.

(21) Appl. No.: 14/767,236

(22) PCT Filed: Nov. 22, 2013

(86) PCT No.: PCT/EP2013/074441

§ 371 (c)(1),
(2) Date: Aug. 11, 2015

(87) PCT Pub. No.: WO2014/124714

PCT Pub. Date: Aug. 21, 2014

(65) Prior Publication Data

US 2015/0375970 A1 Dec. 31, 2015

(30) Foreign Application Priority Data

Feb. 14, 2013 (DE) ..... 10 2013 202 413

(51) Int. Cl.
*B66C 13/16* (2006.01)
*B66C 17/00* (2006.01)
(Continued)

(52) U.S. Cl.
CPC ..... *B66C 13/16* (2013.01); *B66C 13/46* (2013.01); *B66C 13/48* (2013.01); *B66C 17/00* (2013.01)

(58) Field of Classification Search
CPC ..... B66C 13/46; B66C 17/00; B66C 13/16; B66C 13/48
(Continued)

(56) References Cited

U.S. PATENT DOCUMENTS 5,638,718 A 6/1997 Venäläinen ..... 72/447
6,057,777 A 5/2000 Dunne et al.
(Continued)

FOREIGN PATENT DOCUMENTS

CN 1116831 A 2/1996
DE 101 36 398 A1 3/2003
(Continued)

OTHER PUBLICATIONS

International Search Report dated Mar. 12, 2014 issued in corresponding International patent application No. PCT/EP2013/074441.
(Continued)

*Primary Examiner* — Marthe Marc-Coleman
(74) *Attorney, Agent, or Firm* — Ostrolenk Faber LLP

(57) ABSTRACT

A method for calibrating a first movable part of a crane. Position a first crane part above a calibration point at a first predetermined co-ordinate in a reference system. Measure a first distance between a first transmitter/receiver element of a first distance measuring device mounted on the first movable crane part and a second transmitter/receiver element of the first distance measuring device disposed in a stationary manner in the reference system. Measure an orientation of the first transmitter/receiver element in accordance with the first predetermined co-ordinate, the measured first distance and a first item of information concerning the surroundings. Perform a transformation in the reference system in accordance with the ascertained orientation of the first transmitter/receiver element for transforming distance measured during operating of the crane by means of the first
(Continued)

and second transmitter/receiver elements to determine a position of the first movable crane part. Because the method makes use of information concerning the surroundings, an installation position of the first transmitter/receiver element on the first movable crane part does not have to be known precisely. Moreover only one calibration point has to be approached in order to calibrate the crane.

15 Claims, 2 Drawing Sheets

(51) Int. Cl.
*B66C 13/46* (2006.01)
*B66C 13/48* (2006.01)

(58) Field of Classification Search
USPC .... 701/1, 19, 36; 212/312; 702/95; 340/435, 340/436
See application file for complete search history.

(56) References Cited

U.S. PATENT DOCUMENTS 6,415,208 B1 * 7/2002 Pojda ..... B61K 9/08 340/436
7,428,781 B2 * 9/2008 Wickhart ..... B61K 9/08 33/1 BB

FOREIGN PATENT DOCUMENTS

DE 10 2008 019373 A1 1/2009
JP 2000-143151 A 5/2000
WO WO 2008/074882 A1 6/2008

OTHER PUBLICATIONS

Written Opinion dated Mar. 12, 2014 issued in corresponding International patent application No. PCT/EP2013/074441.
Office Action dated Apr. 6, 2016 issued in corresponding Chinese Patent Application No. 201380073077.5 with English translation.

* cited by examiner

METHOD FOR CALIBRATING A MOVABLE CRANE PART OF A CRANE

CROSS-REFERENCE TO RELATED APPLICATIONS

The present application is a 35 U.S.C. §§371 national phase conversion of PCT/EP2013/074441, filed Nov. 22, 2013, which claims priority of German Patent Application No. 10 2013 202 413.4, filed Feb. 14, 2013, the contents of which are incorporated by reference herein. The PCT International Application was published in the German language.

The present invention relates to a method for calibrating a first movable crane part. The present invention furthermore relates to a method for operating a crane, and to a crane.

TECHNICAL BACKGROUND

It is known to provide a crane with a supporting structure, a crane bridge which is movable relative to the supporting structure, and a crane trolley which is movable relative to the crane bridge. Such a crane is used, for example, in a material store in order to transport material between different stations in the material store. Coordinates, for example in the x and y directions, define the precise location of a respective station in a reference system, which has its origin at the supporting structure. The directions x, y are oriented mutually orthogonally. A control device of the crane drives the crane bridge and the crane trolley, in particular by electric motors thereof, such that the crane trolley moves to a respective station. In this case, the control device receives data from a distance measuring system which monitors the positions of the crane bridge and the crane trolley.

Before the crane is put into service, the crane bridge and the crane trolley must be calibrated, so that the actual positions of the crane bridge and of the crane trolley can be calculated directly from the data provided by the distance measuring system.

SUMMARY OF THE INVENTION

It is an object of the present invention to provide an improved method for calibrating a first movable crane part of a crane.

In a method for calibrating a first movable crane part of a crane, in a first step, the first crane part is positioned over a calibration point having a first predetermined coordinate in a reference system. After this, a first distance between a first transmitter/receiver element, fitted on the first movable crane part, of a first distance measuring device and a second transmitter/receiver element, arranged fixed in the reference system, of the first distance measuring device, is measured. An orientation of the first transmitter/receiver element of the first distance measuring device in the reference system is determined as a function of the first predetermined coordinate, the measured first distance and a first environmental information item. In a further step, a transformation is formed as a function of the orientation determined for the first transmitter/receiver element of the first distance measuring device. The information is suitable for transforming a distance measured during operation of the crane by means of the first and second transmitter/receiver elements of the first distance measuring device in order to determine a position of the first movable crane part in the reference system.

Since the orientation of the first transmitter/receiver element is determined by using a first environmental information item, it is only necessary to move to one calibration point for the calibration. To this extent, it is thus not necessary to comply with an elaborate sequence of processes. Furthermore, there is therefore flexibility in fitting the first transmitter/receiver element of the first distance measuring device on the movable crane part. Therefore, the orientation can be selected according to requirements, in particular according to the installation space. The first transmitter/receiver element may, as required, measure both in the positive coordinate direction and in the negative coordinate direction. To this extent, there is also independence in relation to the reference system. A further advantage is that the orientation can be determined in an automated fashion, without intervention of an operator.

A "transmitter/receiver element" is intended to mean an element which is configured as a transmitter and/or receiver. It is essential only that the first and second transmitter/receiver elements interact in order to measure a distance.

The reference system may, for example, be configured to be fixed relative to a supporting structure, with respect to which the first movable crane part is movable. The supporting structure of the crane may, for example, be configured in the form of double T supports, which are mounted fixed on a wall or roof. The crane bridge may, for example, be mounted so as to roll in translation on the supporting structure. The crane trolley may be mounted so as to roll in translation on the crane bridge and transversely to the crane bridge.

The calibration point may be the same as the origin of the reference system. The calibration point will, however, regularly deviate from the origin of the reference system. Advantageously, the calibration point is selected in an outer edge region of an axis, along which the crane bridge or the crane trolley is movable. The calibration point is, in particular, selected by an operator on the operating site after installation of the crane. For example, a plumbline may be fastened on the crane trolley. An operator then moves the crane trolley, or the crane bridge, until the plumbline is arranged over the calibration point, for example in the form of a marking on the floor. The position of the marking relative to the origin of the reference system may, for example, be measured by the operator. The first and/or second predetermined coordinate is thereby obtained.

In the present case, a "transformation" is intended to be an equation, a data set or a transformation matrix, which during operation of the crane (i.e. for example when it moves to different stations of a material store) makes it possible to determine the position of the first movable crane part in the reference system as a function of a distance measured by means of the first distance measuring device.

According to one embodiment, in addition to the first movable crane part, a second crane part which is movable with respect to the first crane part is positioned with the first and a second predetermined coordinate. In addition to the first distance, a second distance between a first transmitter/receiver element, fitted on the second movable crane part, of a second distance measuring device and a second transmitter/receiver element, arranged on the first movable crane part, of the second distance measuring device is measured. Furthermore, in addition to the orientation of the first transmitter/receiver element of the first distance measuring device, an orientation of the first transmitter/receiver element of the second device in the reference system is determined as a function of the second coordinate, the second measured distance and a second environmental information item. The transformation for transforming a distance measured during operation of the crane by means of the first and second transmitter/receiver elements of the second distance measuring device in order to determine a position of the second movable crane part in the reference system is additionally formed as a function of the orientation determined for the first transmitter/receiver element of the second measuring device. In this way, the first crane part can be calibrated in a first direction of the reference system and the second crane part can be calibrated in a second direction of the reference system.

In another embodiment, a position of the first transmitter/receiver element of the first and/or second distance measuring device in the reference system is determined. After this, the transformation is formed as a function of the position determined and the orientation determined.

The determination may also comprise reading out. For example, the coordinates of the calibration point may be stored in a memory, in particular of the crane. In applications in which the exact position of the first transmitter/receiver element with respect to the first movable crane part is not very important, the coordinates of the calibration point may be selected to be equal to the position of the transmitter/receiver element of the first distance measuring device. Consequently, it may be sufficient merely to read out a memory which contains the coordinates. Corresponding considerations apply for the position of the first transmitter/receiver element of the second distance measuring device. If, however, the position of the first transmitter/receiver element of the first and/or second distance measuring device is not read out from a memory, but is determined by using the measurement results provided by the first and/or second distance measuring device, then the mounting position of the first transmitter/receiver element of the first and/or second distance measuring device on the first, or respectively second, crane part also contributes to the transformation formed. There is therefore more accurate determination of the position of the first or second movable crane part in the reference system during operation of crane, without the transmitter/receiver element of the first and/or second distance measuring device having had to be mounted at a predefined position on the first or second crane part for this purpose. This simplifies mounting as well as the first use of the crane. Provision may be made for the position of the first transmitter/receiver element of the first and/or second distance measuring device to be determined after the step of determining the orientation of the first transmitter/receiver element of the first and/or second distance measuring device.

In another embodiment, the position of the first transmitter/receiver element of the first distance measuring device in the reference system is determined as a function of the first predetermined coordinate, the first measured distance and the orientation determined for the first transmitter/receiver element of the first distance measuring device. In addition, the position of the first transmitter/receiver element of the second distance measuring device in the reference system may be determined as a function of the second predetermined coordinate, the second measured distance and the orientation determined for the first transmitter/receiver element of the second distance measuring device. In this way, the position of the first transmitter/receiver element of the first and/or second measuring device can be determined straightforwardly.

In another embodiment, the formation of the transformation comprises the formation of a rotation matrix as a function of the orientation determined for the first transmitter/receiver element of the first and/or second distance measuring device and/or a translation matrix as a function of the position determined for the first transmitter/receiver element of the first and/or second distance measuring device. The formation of the transformation may comprise the formation of a transformation matrix. The transformation matrix may comprise a translational part, i.e. the aforementioned translation matrix, and a rotational part, i.e. the aforementioned rotation matrix. The transformation matrix may, for example, be stored in a memory of the crane. By means of the transformation matrix the first and/or second measured distance can be converted straightforwardly into the position of the first and/or second crane part in the reference system during operation of the crane.

In another embodiment, the position of the calibration point is selected as a function of the accuracy of the first and/or second environmental information item. If the information item is for example very accurate, i.e. only affected by a small tolerance, then the calibration point may be selected very close to the mean value of the environmental information item. If however the environmental information item is fuzzy, i.e. affected by a large tolerance, then the position of the calibration point must be selected far away from the mean value of the environmental information item. Otherwise, the orientation of the first transmitter/receiver element of the first and/or second measuring device may not be determined uniquely.

In another embodiment, the calibration point is selected outside a tolerance range around a mean value of the environmental information item. Values not excluded thereby for the calibration point may be calculated in an automated fashion by a device of the crane and, for example, displayed to an operator. The operator may then apply a marking corresponding to the calibration point on the floor of the material store.

In another embodiment, the calibration point is selected as a function of a position information item of the first transmitter/receiver element of the first and/or second distance measuring device with respect to the first and/or second crane part. The position of the calibration point and the accuracy of the position information item decide inter alia whether the orientation of the first transmitter/receiver element of the first and/or second distance measuring device can be determined uniquely. In this case as well, a non-excluded range for the position of the calibration point may be calculated by a device of the crane and may, for example, be displayed to an operator. The operator then takes this information into account when applying a marking corresponding to the calibration. In one embodiment, in addition to the accuracy of the environmental information item, the accuracy of the position information item may be taken into account in the selection of the calibration point.

According to one embodiment, the first and second distances are measured along mutually orthogonal axes. For example, the orthogonal axes may correspond to a width and length direction of a material store.

One axis could, however, also extend in the height direction of a material store.

In another embodiment, the first movable crane part is configured as a crane bridge and/or the second crane part is configured as a crane trolley.

According to another embodiment, the crane bridge and the crane trolley are displaceable with respect to one another along orthogonal axes. The axes may, in particular, extend in the width and length directions of a material store.

According to another embodiment, the first and/or second distance measuring device uses a radio signal for measuring the first and/or second distance. The first and/or second transmitter/receiver elements may, for example, be configured as a transponder. As an alternative, the first and/or second measuring device could also, for example, employ an optical distance measurement method, for example by means of a laser.

In another embodiment, the first and/or second environmental information item is formed as a dimension of a material store comprising the first and/or second crane part. The dimension may also be that of a supporting structure, which comprises the first and/or second crane part, or which receives or spans the material store. For example, the first environmental information item may be configured as the length of a material store and the second environmental information item may be configured as the width of the material store. The dimension in this case defines the maximum positions of the first and/or second crane part along one axis. For example, the dimension (first environmental information item) may be configured as the length of a supporting structure, along which the crane bridge is movable.

Furthermore, the dimension (second environmental information item) may be configured as the length of the crane bridge, along which the crane trolley is movable. The dimensions therefore correspond to the width and length extents of the supporting structure, which also correspond to those of the material store which can be reached by means of the crane.

A method for operating a crane is furthermore provided. In this method, a position of a first and/or second movable part in a reference system is determined as a function of the transformation described above.

A crane is furthermore provided, having a first movable crane part, a device for positioning the first movable crane part over a calibration point having a first predetermined coordinate in a reference system, a first distance measuring device having a first and second transmitter/receiver element, the first transmitter/receiver element being fitted on the first crane part and the second transmitter/receiver element being arranged fixed in the reference system, the first distance measuring device being configured in order to measure a first distance between the first and second transmitter/receiver elements, a device for determining an orientation of the first transmitter/receiver element of the first distance measuring device in the reference system as a function of the first predetermined coordinate, the measured first distance and a first environmental information item, and a device for forming a transformation as a function of the orientation determined for the first transmitter/receiver element of the first distance measuring device for transforming a distance measured during operation of the crane by means of the first and second transmitter/receiver elements in order to determine a position of the first movable crane part in the reference system.

The embodiments described above for the calibration method may also be applied correspondingly to the method for operating a crane, and to the crane.

The device for positioning the first movable crane part may, for example, be embodied as a control and evaluation device having an electric motor driven thereby. The device for determining the orientation, and the device for forming the transformation, may likewise be configured in the form of the aforementioned control and evaluation device.

The properties, features and advantages of this invention as described above, and the way in which they are achieved, will become more clearly and readily compensable in conjunction with the following description of the exemplary embodiments, which will be explained in more detail in connection with the drawings.

In the figures, elements which are the same or functionally equivalent have been provided with the same references, unless otherwise indicated.

DESCRIPTION OF EMBODIMENT

Figure 1:
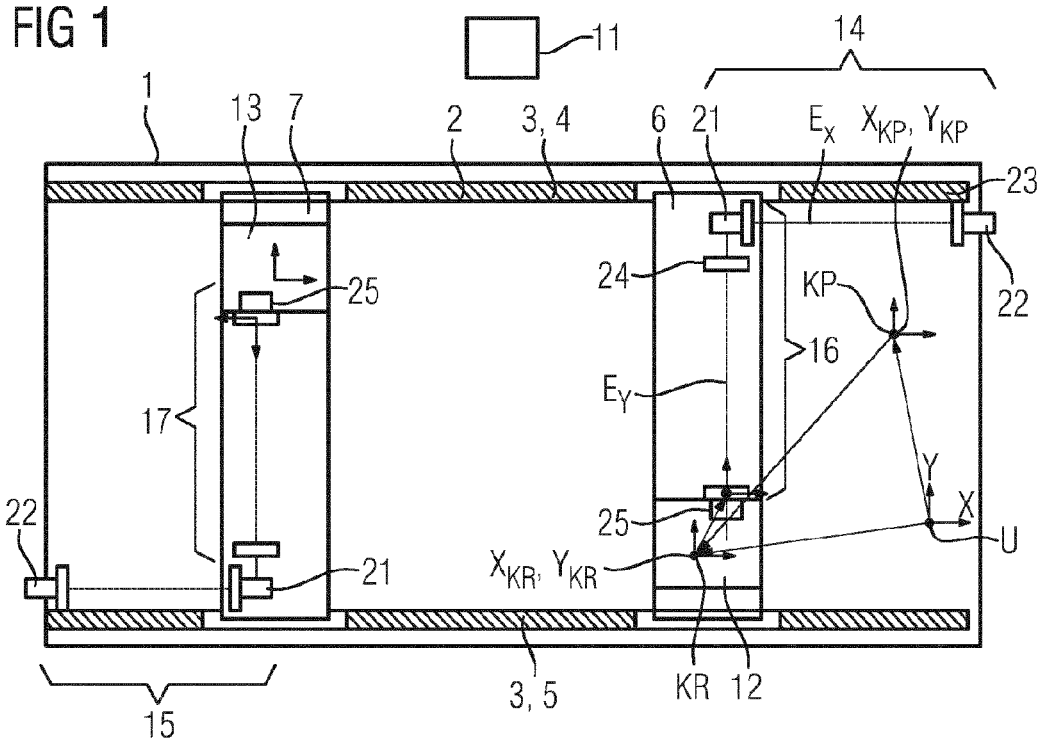
FIG. 1 shows a plan view of a material store having a crane according to one embodiment.

FIG. 1 shows a plan view of material store 1 having a crane 2.

The crane 2 is configured as an underslung crane, and to this end comprises for example an I-beam comprised of double T supports 4, 5 forming a supporting structure 3 of the crane 2. The double T supports 4, 5 are flanges of the I-beam and the crane 2 defines a web joining the flanges lie parallel opposite one another and are, for example, arranged below a roof (not represented) of a building (not represented) which comprises the material store 1.

The crane 2 furthermore comprises two first movable crane parts in the form of crane bridges 6, 7. The crane bridges 6, 7 are mounted at their opposite ends, for example by means of rollers, on the double T supports 4, 5, and are therefore mounted movably in the direction (longitudinal direction) denoted by x of the double T supports 4, 5. To this end, an electric motor (not represented) drives the respective crane bridges 6, 7 correspondingly. A control and evaluation device, denoted by 11, of the crane 2 in turn drives the electric motors. The control and evaluation device 11 is configured for example in the form of a computer device, particularly in the form of a microprocessor.

The crane 2 furthermore comprises two second movable crane parts in the form of crane trolleys 12, 13. A respective crane trolley 12, 13 is mounted longitudinally movably in a transverse direction denoted by y of a respective crane bridge 6, 7. For example, the crane bridges 6, 7 may respectively likewise be configured in the form of I-beams or double T supports, on which a respective crane trolley 12, 13 is mounted movably, for example by means of rollers. A respective electric motor drives the crane trolleys 12, 13 as a function of a control signal of the control and evaluation device 11 in their longitudinal direction y which is transverse to direction x. Open areas alone, the supports 4 and 5 permit such transverse movement of the crane trolleys 12, 13.

The crane 2 furthermore comprises two first distance measuring devices 14, 15 and two second distance measuring devices 16, 17. The structure and the functionality of the distance measuring devices 14, 15, 16, 17 will be explained in more detail below with reference to the distance measuring devices 14, 16 for the crane bridge 6 and the crane trolley 12, but this also applies correspondingly for the distance measuring devices 15, 17 which are assigned to the crane bridge 7 and to the crane trolley 13.

The first distance measuring device 14 comprises a first transmitter/receiver element in the form of a transponder 21, which is fitted on the crane bridge 6. The first distance measuring device 14 furthermore comprises a second transmitter/receiver element in the form of a transponder 22. The transponder 22 is fitted firmly on the outermost end 23 of the double T support or flange 4. The transponders 21, 22 exchange a radio signal, with the aid of which the distance measuring device 14 can determine a first distance $E_x$ between the transponders 21, 22.

The second distance measuring device 16 comprises a first transmitter/receiver element in the form of a transponder 21, which is equipped with an additional antenna 24. The second distance measuring device 16 further comprises a second transmitter/receiver element in the form of a transponder 25. The transponder 25 is fitted firmly on the crane trolley 12 and lies opposite the transponder 21, or the antenna 24. The transponders 21, 25 likewise exchange a radio signal, with the aid of which the second distance measuring device 16 can determine a second distance $E_y$ between the two transponders 21, 25. The transponder 25 may be part of a base station of the first and second distance measuring devices 14, 16, which transmits the measured first and second distances $E_x$, $E_y$ to the control and evaluation device 11.

The material store 1 has an origin U. A reference system, which comprises the x and y directions, is established at the origin U. The stations, to which a respective crane trolley 12, 13 is to move, in the material store 1 are defined from the origin U. The origin U and the reference system are likewise stored in electronic form in a memory in the control and evaluation device 11, for example as a table. The origin U corresponds to the [0, 0] position of the respective crane trolley 12, 13. Typically, however, the crane trolleys 12, 13 cannot be moved to the origin U.

A method for calibrating the crane bridge 6 of the crane trolley 12 will explained in more detail below with the aid of FIG. 2.

These comments apply correspondingly to the crane bridge 7 and to the crane trolley 13. The calibration is necessary in order to ensure that the position to which the crane trolley 12 moves coincides with a desired position. The desired position may, for example, be provided to the control and evaluation device 11 by means of an input device (not shown). The input at the input device may be carried out by an operator.

Figure 3:
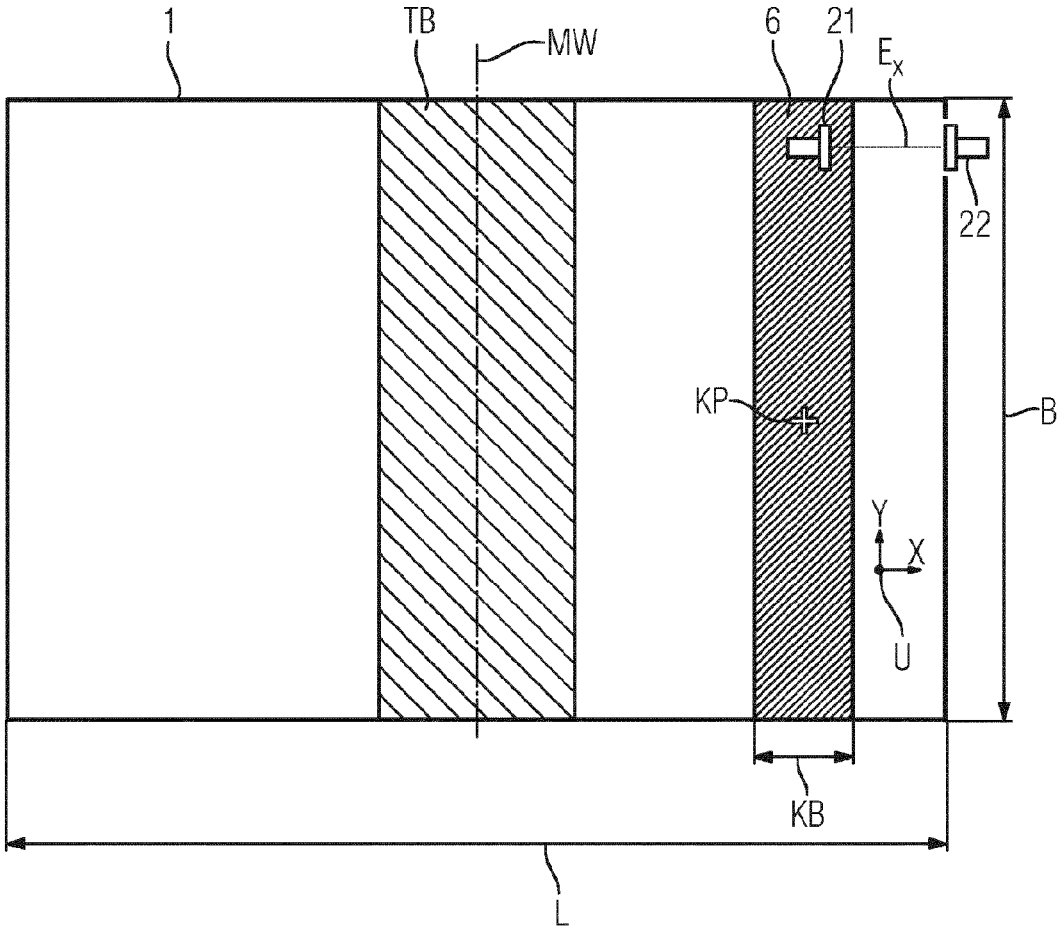
FIG. 3 shows a view of FIG. 1 in a simplified and partially supplemented representation.

In a first step 200, a suitable calibration point KP in the material store 1 is then selected. The selection of the calibration point KP in step 200 may depend on a plurality of information items. Firstly, a first environmental information item and a second environmental information item in the form of a length L and a width B of the material store 1 are taken into account. This will be explained in more detail below by way of example with reference to FIG. 3 for the length L; it likewise applies for the width B. FIG. 3 in this case shows a simplified representation of the material store 1 and of the crane 2 of FIG. 1, the crane bridge 6 being at the calibration point KP.

The length L of the material store is, for example, 100 m, and is known within a certain tolerance, for example ±1 m. A mean value MW of the length L is shown as a dot and dash line in FIG. 3. Around the mean value MW there is in turn a tolerance range TB of, for example ±1 m. If the calibration point KP lies within the tolerance range TB, then the orientation of the transponder 21 can no longer be established uniquely, as explained in more detail below. The orientation of the transponder 21 is intended to mean whether it points in the positive and negative x direction of the reference system. In other words, it is then no longer possible to establish on which side of the material store 1 the transponder 22 is arranged, so that between which two points the distance $E_x$ is measured is not defined.

A further information item, on which the selection of the calibration point KP may depend, is a position information item relating to the fitting of the transponder 21 on the crane bridge 6. In particular, the position information item may comprise a width of the crane bridge KB. Although the position at which the transponder 21 is fitted on the crane bridge 6 does not have to be known precisely—and this is precisely an advantage of the present method—nevertheless a calibration point KP selected too close to the mean value MW, in the case of a correspondingly large width KB, may likewise lead to the orientation of the transponder 21 no longer being determinable uniquely.

Taking into account the environmental information items B, L and the position information item KB, there is then a permissible range within which the calibration point KP may be selected. This permissible range may, for example, be displayed to an operator on a display device (not represented) of the crane 2. The operator then selects an arbitrary point within the permissible range and marks it, for example, on the floor of the material store 1. After this, the operator determines the coordinates of the calibration point KP in relation to the origin of the reference system. The calibration point is thus, for example, given the coordinates $x_{KP}$ and $y_{KP}$, see FIG. 1.

Figure 2:
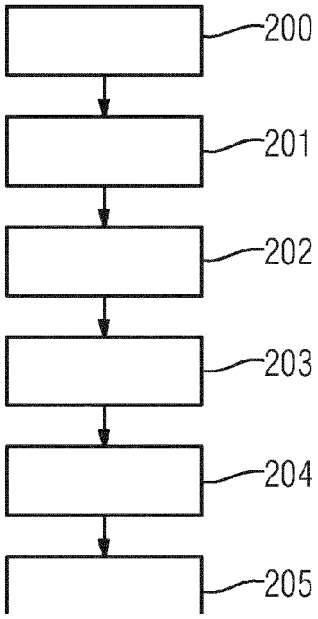
FIG. 2 shows a flowchart according to one exemplary embodiment.

In a step 201 in FIG. 2, a plumbline is then for example fastened on the crane trolley 12, and the crane trolley 12 is moved to the calibration point KP by means of driving by the control and evaluation device 11 as a function of an input by the operator, so that the plumbline is suspended over the point KP. The plumbline may be fastened on a crane trolley reference point KR. After this, the operator informs the control and evaluation device 11 that the calibration point KP has been reached. The control device 11 then stores the coordinates $x_{KP}$, $y_{KP}$ in a memory (not represented) thereof.

In a further step 202 (see FIG. 2) the distance $E_x$ is measured.

In a step 203, the control and evaluation device 11 determines the orientation of the transponder 21 with the aid of the measured distance $E_x$, the stored coordinate $x_{KP}$ and the environmental information item L. Specifically, with the aid of the coordinate $x_{KP}$ and the length L, the control and evaluation device 11 can determine on which side (relative to the mean value MW, see FIG. 3) of the material store 1 the transponder 21 lies in relation to the x direction. If the measured distance $E_x$ is then furthermore taken into account, then the control and evaluation device 11 can establish the direction in which the transponder 21 is "looking", or where the corresponding transponder 22 is arranged. In the exemplary embodiment of the FIG. 1, the control and evaluation device 11 would establish that the transponder 21 is oriented in the positive x direction.

Furthermore, the evaluation and control device 11 may determine the position of the transponder 21 in the x direction in a step 204. In a simplified embodiment of the method, this position is assumed to be $x_{KP}$, since, in the case of a small crane width KB (see FIG. 3), this differs only insubstantially from the position of the crane bridge 6 at the calibration point KP. Correspondingly, the coordinate $x_{KP}$ is read out from the memory of the evaluation and control device 11 as the position of the transponder 21. In another embodiment, in which the position of the transponder 21 is intended to be determined more accurately, it may be determined with the aid of the coordinate $x_{KP}$ and the measured distance $E_x$ as well as the orientation of the transponder 21.

The orientation of the transponder 25 of the second position measuring device 16 is likewise determined in step

203 as a function of the coordinate $y_{KP}$, the measured distance $E_y$ and the width B of the material store 1. The orientation of the transponder 25 may be in the positive or negative y direction.

Furthermore, in step 204 the position of the transponder 25 in the y direction is also determined. This is done in a manner corresponding to the position determination for the transponder 21 in the x direction.

With the aid of the orientation and position of the transponders 21, 25 which have now been determined, in a step 205, a transformation is then formed, illustrated in FIG. 1 by the arrows joining the origin U, the calibration point KP, the crane reference point KR and the transponder 25. The transformation may be formed, in particular, in the form of a transformation matrix. This may have a rotational component and a translational component. The rotational component may in turn be described by rotation matrices describing the orientation of the transponders 21, 25. The translational component may in turn be described by translation matrices describing the position of the transponders 21, 25.

The transformation matrix formed in this way may, for example, be stored in the memory (not shown) of the control and evaluation device 11. During operation, the distances $E_x$, $E_y$ measured by the first and second measuring devices 14, 16 can be converted into a position $x_{KR}$, $y_{KR}$ by means of the transformation matrix. In this way, the control and evaluation device 11 can precisely control the crane trolley 12 in order to reach any desired station in the material store 1.

The invention claimed is:

1. A method for calibrating a first movable crane part of a crane, the method comprising the steps:

positioning the first movable crane part over a calibration point (KP) having a first predetermined coordinate ($x_{KP}$) in a reference system (x, y);

measuring a first distance ($E_x$) between a first transmitter/receiver element of a first distance measuring device, wherein the first transmitter receiver device is fitted on the first movable crane part, and a second transmitter/receiver element, arranged fixed in the reference system (x, y), of the first distance measuring device, determining an orientation of the first transmitter/receiver element of the first distance measuring device in the reference system (x, y) as a function of the first predetermined coordinate ($x_{KP}$), the measured first distance ($E_x$) and a first environmental information item (L), and forming a transformation as a function of the orientation determined for the first transmitter/receiver element of the first distance measuring device for transforming a distance ($E_x$) measured during operation of the crane by means of the first and second transmitter/receiver elements of the first distance measuring device in order to determine a position ($x_{KR}$) of the first movable crane part in the reference system (x, y).

2. The method as claimed in claim 1, further comprising positioning a second movable crane part, which is movable with respect to the first crane part, over the calibration point (KP) with the first and a second predetermined coordinate ($x_{KP}$, $y_{KP}$);

in addition to measuring the first distance ($E_x$), measuring a second distance ($E_y$) between a first transmitter/receiver element, fitted on the second movable crane part, of a second distance measuring device and a second transmitter/receiver element, arranged on the first movable crane part, of the second distance measuring device;

in addition to determining the orientation of the first transmitter/receiver element of the first distance measuring device, determining an orientation of the first transmitter/receiver element of the second device) in the reference system (x, y) as a function of the second coordinate ($y_{KP}$), the second measured distance ($E_y$) and determining a second environmental information item (B); and additionally forming the transformation for transforming a distance ($E_y$) measured during operation of the crane by means of the first and second transmitter/receiver elements of the second distance measuring device to determine a position ($y_{KP}$) of the second movable crane part in the reference system (x, y) as a function of the orientation determined for the first transmitter/receiver element of the second measuring device.

3. The method as claimed in claim 2, further comprising:

forming the transformation comprises forming a rotation matrix as a function of the orientation determined for the first transmitter/receiver element of the first and/or second distance measuring device and/or forming a translation matrix as a function of the position determined for the first transmitter/receiver element of the first and/or second distance measuring device.

4. The method as claimed in claim 2, further comprising:

measuring the first and second distances ($E_x$, $E_y$) along mutually orthogonal axes (x, y).

5. The method as claimed in claim 1, further comprising:

determining a position of the first transmitter/receiver element of the first and/or second distance measuring device in the reference system (x, y); and forming the transformation as a function of the position determined and the orientation determined.

6. The method as claimed in claim 5, further comprising:

determining the position of the first transmitter/receiver element of the first distance measuring device in the reference system (x, y) as a function of the first predetermined coordinate ($x_{KP}$), the first measured distance ($E_x$) and the orientation determined for the first transmitter/receiver element of the first distance measuring device; and/or determining the position of the first transmitter/receiver element of the second distance measuring device in the reference system (x, y) as a function of the second predetermined coordinate ($y_{KP}$), the second measured distance ($E_y$) and the orientation determined for the first transmitter/receiver element of the second distance measuring device.

7. The method as claimed in claim 1, further comprising:

selecting the position of the calibration point (KP) as a function of the accuracy of the first and/or a second environmental information item (B, L).

8. The method as claimed in claim 7, further comprising:

selecting the calibration point (KP) outside a tolerance range (TB) around a mean value (MW) of the environmental information item (L).

9. The method as claimed in claim 1, further comprising:

selecting the calibration point (KP) as a function of a position information item (KB) of the first transmitter/receiver element of the first and/or second distance measuring device with respect to the first and/or second crane part.

10. The method as claimed in claim 1, further comprising the first movable crane part is configured as a crane bridge which is movable in a direction longitudinally along the crane bridge and/or the second crane part is configured as a crane trolley which is movable transversely of the longitudinal direction along the crane bridge.

11. The method as claimed in claim 10, further comprising displacing the crane bridge and the crane trolley with respect to one another along orthogonal axes (x, y).

12. The method as claimed in claim 1, further comprising the first and/or second distance measuring device uses a radio signal for measuring the first and/or second distance ($E_x$, $E_y$).

13. The method as claimed in claim 1, wherein the first and/or second environmental information item (B, L) is formed as a dimension of a material store comprising the first and/or second crane part.

14. A method for operating a crane, wherein a position ($x_{KR}$, $y_{KR}$) of a first and/or a second movable part in a reference system (x, y) is determined as a function of a transformation formed as claimed in claim 1.

15. A crane comprising:

a calibration point having a first predetermined coordinate ($x_{KP}$) in a reference system (x,y);

a first movable crane part;

a device for positioning the first movable crane part over the calibration point (KP);

a first distance measuring device having a first and a second transmitter/receiver element;

the first transmitter/receiver element being fitted on the first crane part and the second transmitter/receiver element being arranged fixed in the reference system (x, y), the first distance measuring device being configured to measure a first distance ($E_x$) between the first and second transmitter/receiver elements;

a device for determining an orientation of the first transmitter/receiver element of the first distance measuring device in the reference system (x, y) as a function of the first predetermined coordinate ($X_{KP}$), the measured first distance ($E_x$) and a first environmental information item (L); and a device configured for forming a transformation as a function of the orientation determined for the first transmitter/receiver element of the first distance measuring device (14) for transforming a distance ($E_x$) measured during operation of the crane (2) by means of the first and second transmitter/receiver elements to determine a position ($x_{KR}$) of the first movable crane part in the reference system (x, y).

* * * * *